US007478487B2

(12) United States Patent
Dalla Rosa

(10) Patent No.: US 7,478,487 B2
(45) Date of Patent: Jan. 20, 2009

(54) BREATHABLE SOLE STRUCTURE

(75) Inventor: Angelo Dalla Rosa, Sona (IT)

(73) Assignee: Europa Studio Shoes S.R.L., Verona (IT)

( * ) Notice: Subject to any disclaimer, the term of this patent is extended or adjusted under 35 U.S.C. 154(b) by 87 days.

(21) Appl. No.: 11/753,841

(22) Filed: May 25, 2007

(65) Prior Publication Data

US 2008/0172910 A1 Jul. 24, 2008

(30) Foreign Application Priority Data

Jan. 18, 2007 (EP) ..... 07425022

(51) Int. Cl.
*A43B 7/08* (2006.01)

(52) U.S. Cl. ..... 36/3 B

(58) Field of Classification Search ..... 36/3 B, 36/3 R, 3 A, 29

See application file for complete search history.

(56) References Cited

U.S. PATENT DOCUMENTS 6,014,823 A * 1/2000 Lakic ..... 36/93
6,282,813 B1 * 9/2001 Squadroni ..... 36/3 B
6,338,206 B1 * 1/2002 Kita ..... 36/29
7,316,081 B1 * 1/2008 Cheng ..... 36/3 R
2003/0121174 A1 * 7/2003 Tsai et al. ..... 36/3 B

* cited by examiner

*Primary Examiner*—Ted Kavanaugh
(74) *Attorney, Agent, or Firm*—Pearne & Gordon LLP

(57) ABSTRACT

A breathable sole structure has a lower face (2) which in practice forms the tread, and an upper face (3) which in practice faces the inside of the item of footwear, the breathable sole structure (1) having at least one ventilation duct (4) extending from an inlet section (5) made in the upper face (3) to an outlet section (6) made in the lower face (2). The ventilation duct (4) comprises at least one main stretch (7) which is substantially parallel with a longitudinal direction of extension of the sole structure (1) and has a first end (8) and a second end (9) in communication with the outlet section (6). A dome-shaped portion (10) which is elastically deformable is made on the upper face (3) and inside it forms a chamber (11) connected to the first end (8) of the main stretch (7). The dome-shaped portion also has an opening which forms the ventilation duct (4) inlet section (5).

28 Claims, 4 Drawing Sheets

BREATHABLE SOLE STRUCTURE

FIELD OF THE INVENTION

The present invention relates to a sole structure formed in such a way that it can make the item of footwear to which it is applied breathable.

BACKGROUND OF THE INVENTION

The problem of producing footwear able to allow the wearer's foot to breathe has been of interest for almost thirty years.

In particular, most technological research to obtain breathable footwear focused on the production of particular sole structures.

Thus, footwear was initially invented in which the sole had holes though its thickness, creating air channels extending directly from the inside to the outside of the item of footwear.

However, this first prior art had the significant disadvantage of allowing not just air but also water to pass through, meaning that the item of footwear was practically unusable in bad weather.

To overcome this disadvantage, footwear was produced in which the holes made through the sole were intercepted by a waterproof membrane which still allowed water vapour to pass.

In contrast, alternative embodiments brought the creation of footwear with internal channelling, pumping elements and so on, and in which the air inlet was made laterally to the sole.

SUMMARY OF THE INVENTION

In this situation, the technical purpose which forms the basis of the present invention is to provide a breathable sole structure which is an alternative to those already existing.

In particular, the technical purpose of the present invention is to provide a sole structure which is breathable.

Another technical purpose of the present invention is to provide a breathable sole structure which substantially prevents water from entering the item of footwear in normal conditions of use.

The technical purpose specified and the aims indicated are substantially achieved by a breathable sole structure as described in the claims herein.

BRIEF DESCRIPTION OF THE DRAWINGS

Further features and advantages of the present invention are more apparent in the detailed description below, with reference to several preferred, non-limiting embodiments of a breathable sole structure, illustrated in the accompanying drawings, in which.

DESCRIPTION OF THE PREFERRED EMBODIMENT

Figure 1:
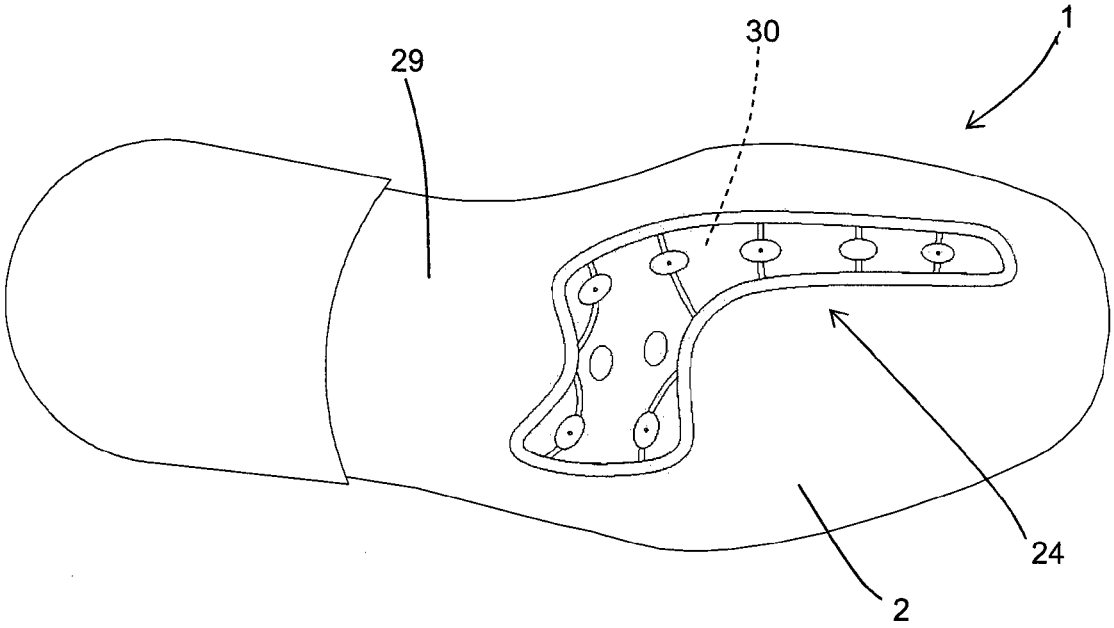
FIG. 1 is a bottom view of a breathable sole structure made in accordance with the present invention.
Figure 2:
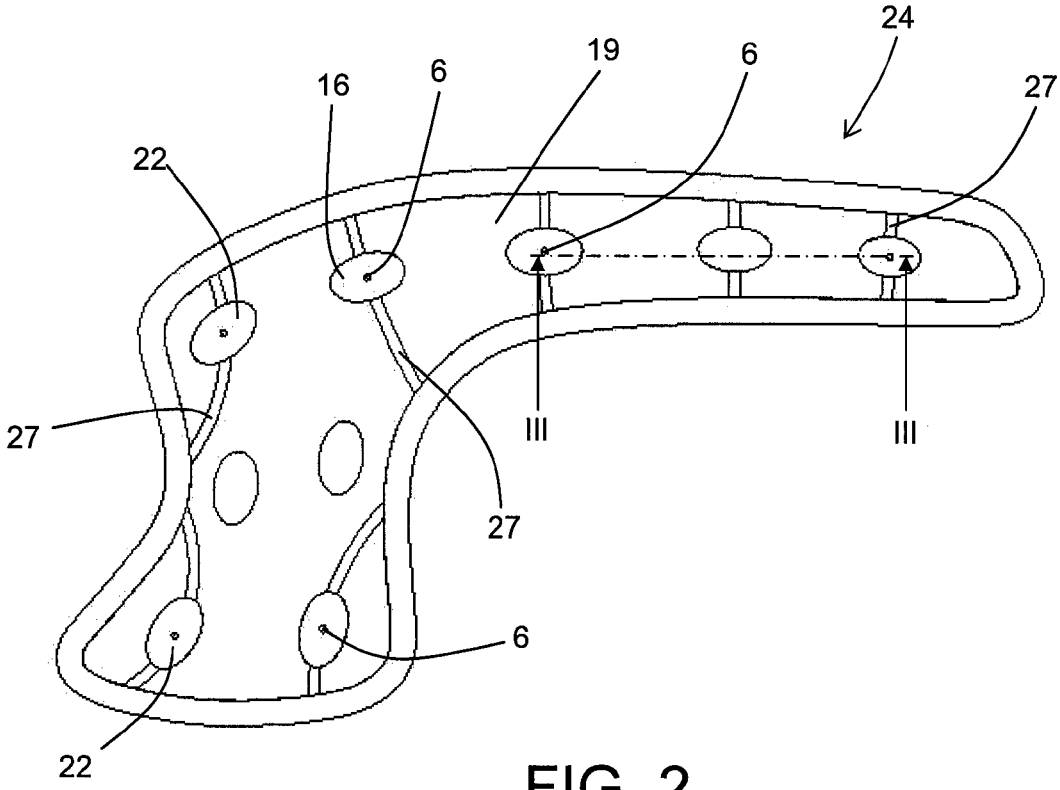
FIG. 2 is an enlarged detail of the sole structure of FIG. 1.

With reference to the accompanying drawings, the numeral 1 denotes as a whole a breathable sole structure made in accordance with the present invention.

The breathable sole structure 1 disclosed has, in the known way, a lower face 2 which in practice is designed to form the tread of the item of footwear to which the sole is applied, and an upper face 3 which, in practice, faces the inside of the item of footwear to which the sole is applied.

In a finished item of footwear, the upper face 3 is normally covered by an insole and/or arch-support (not illustrated) which can allow the wearer's foot to breathe.

The sole structure 1 has at least one ventilation duct 4 extending from an inlet section 5 made in the upper face 3 to an outlet section 6 made in the lower face 2.

The duct comprises at least one main stretch 7 extending in a plane substantially parallel with the longitudinal direction of extension (from heel to tip) of the breathable sole structure 1 (a plane which, in practice is practically horizontal and parallel with the ground). The main stretch 7 of the ventilation duct 4 extends from a first end 8 to a second end 9 which is in fluid communication with the duct outlet section 6. Moreover, advantageously, the main stretch 7 of the ventilation duct 4 extends in the thickness of the breathable sole structure 1.

The sole structure 1 also comprises at least one dome-shaped portion 10 made of elastically deformable material, extending in a raised fashion from the upper face 3. The dome-shaped portion 10 forms, inside it, a chamber 11 in fluid communication with the first end 8 of the main stretch 7 of the ventilation duct 4. The dome-shaped portion 10 also has an opening which puts the inner chamber 11 in communication with the outside of the upper face 3. Said opening, advantageously made at the top of the dome-shaped portion 10, forms the ventilation duct 4 inlet section 5.

In the embodiment illustrated, the ventilation duct 4 substantially consists of a secondary stretch 12, forming the outlet section 6 and extending transversally/perpendicularly to the main stretch 7, of the main stretch 7 whose second end 9 is connected to the secondary stretch 12, and of the dome-shaped portion 10.

In general, the main stretch 7 preferably has a cross-section of less than 2 $mm^2$ (more preferably it is less than 1 $mm^2$), whilst the secondary stretch 12, which may have a larger cross-section, has a cross-section of less than 4 $mm^2$.

Figure 9:
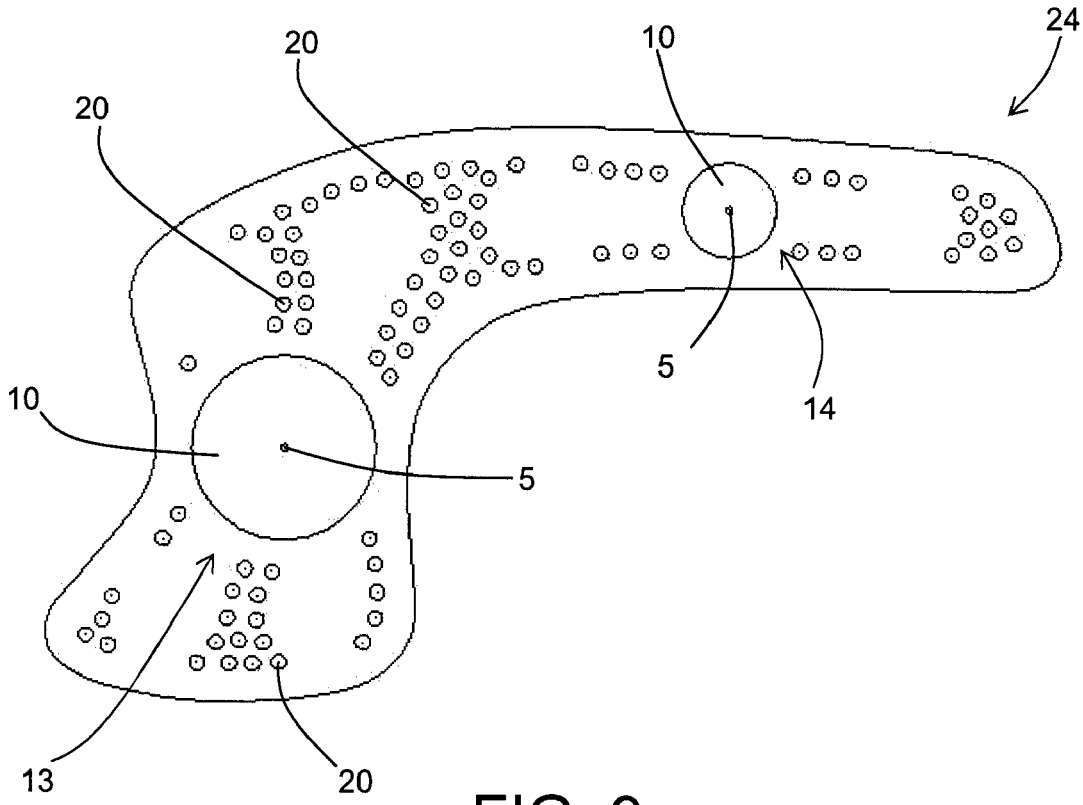
FIG. 9 is a top view of the detail of FIG. 2 of the breathable sole structure in accordance with the present invention.
Figure 10:
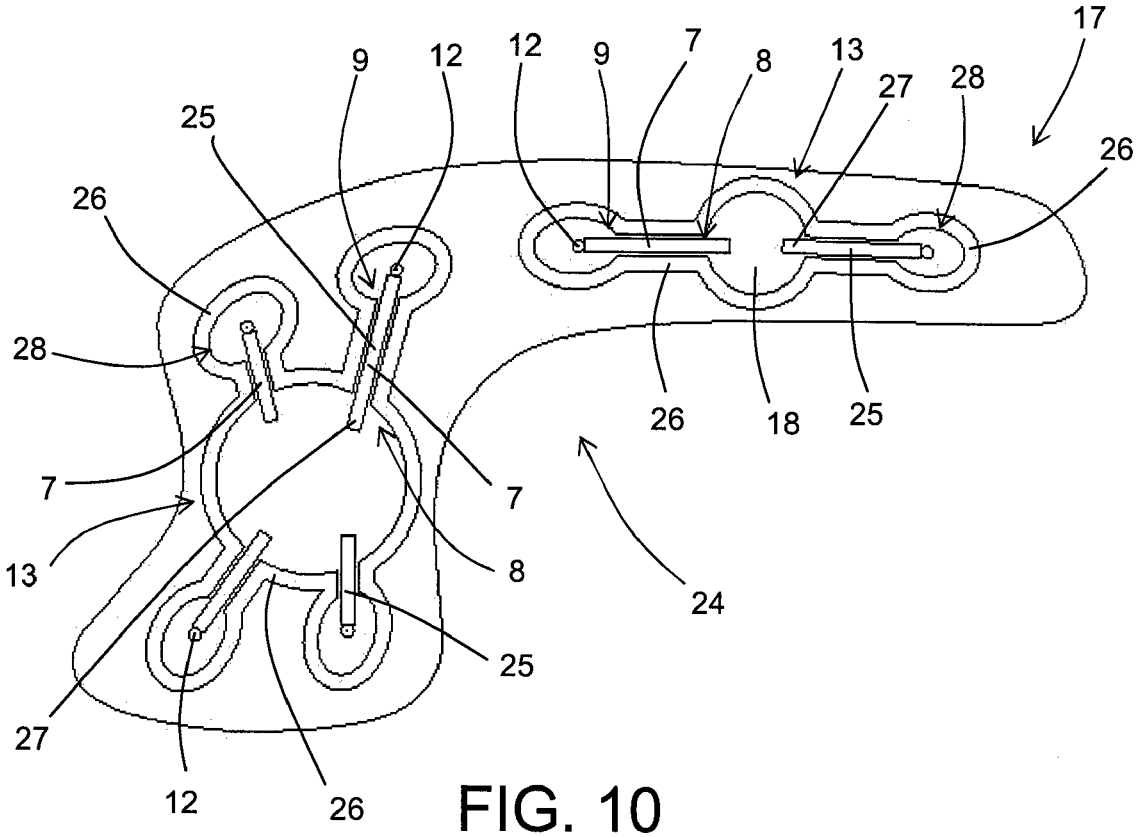
FIG. 10 is a top view, with the upper part cut away, of an alternative embodiment of the detail of FIGS. 2 to 9.

However, in the preferred embodiments of the present invention, the sole structure 1 has a plurality of ventilation ducts 4 which may have various configurations. In particular, there may be a plurality of ventilation ducts 4 which have the chamber 11 formed by the dome-shaped portion 10 as a shared stretch. For example, as shown in FIGS. 9 and 10, in the embodiment illustrated, there are two dome-shaped portions 10, a main dome-shaped portion 13 shared by four different ventilation ducts 4 and in which four main stretches 7 of ventilation ducts 4 converge, and a secondary dome-shaped portion 14 (also shown in FIGS. 3 to 8) shared by two different ventilation ducts 4 and in which two main stretches 7 of ventilation ducts 4 therefore converge.

Therefore, in general, as well as a plurality of ventilation ducts 4 there may also be a plurality of dome-shaped portions 10, each forming a chamber 11 in fluid communication with the first end 8 of at least one main stretch 7 of a ventilation duct 4.

In the preferred embodiment, at least the main stretch 7 of each ventilation duct 4 is obtained in a portion of the breathable sole structure 1 made of waterproof, elastically deformable material. In this way, when the user places his foot on the ground it results in elastic compression of the main stretch 7 which tends to occlude itself, preventing water from infiltrating the item of footwear.

Advantageously, the chamber 11 of each dome-shaped portion 10 has a volume greater than that of the main stretch 7/the main stretches 7 of all of the ventilation ducts 4 connected to it. In this way, when the user places his foot on the ground, it compresses the dome-shaped portion 10, closing the inlet section 5, and causes the air contained in the chamber 11 to be expelled through the main stretches 7 connected to it, simultaneously resulting in both air change in the item of footwear and emptying the ventilation ducts 4 of any water which may have penetrated them (a more detailed description is provided below).

Figure 4:
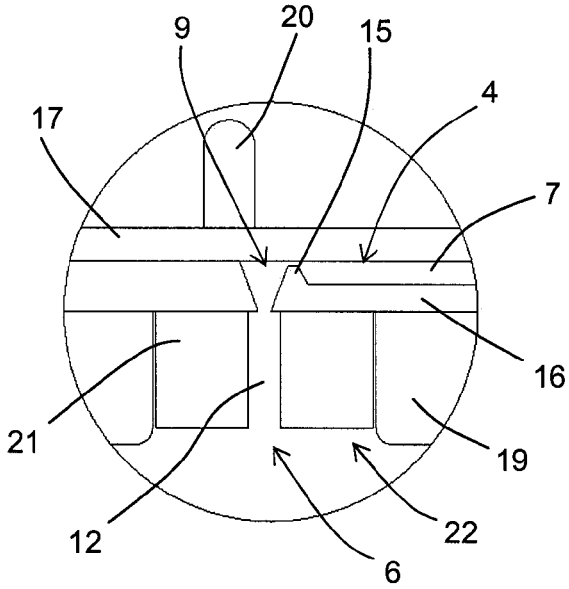
FIG. 4 is an enlarged view of the detail IV of FIG. 3.
Figure 5:
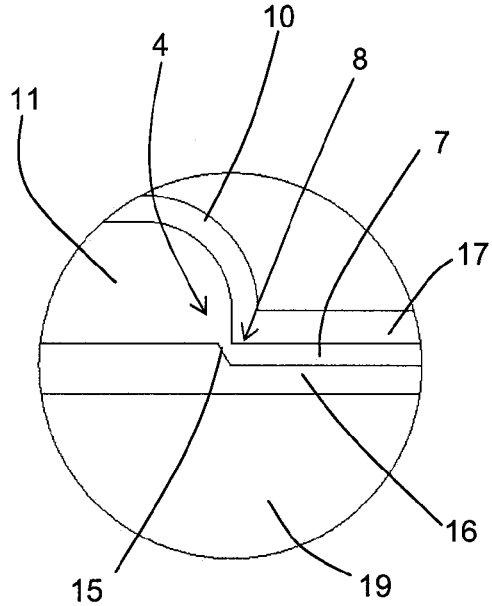
FIG. 5 is an enlarged view of the detail V of FIG. 3.

Advantageously, the ventilation duct 4 may have at least one narrowing 15 close to at least one of the first and second ends 8, 9 of the main stretch 7. FIGS. 4 and 5, by way of a example only, show the case of a double narrowing 15, at both ends of the main stretch 7.

Figure 3:
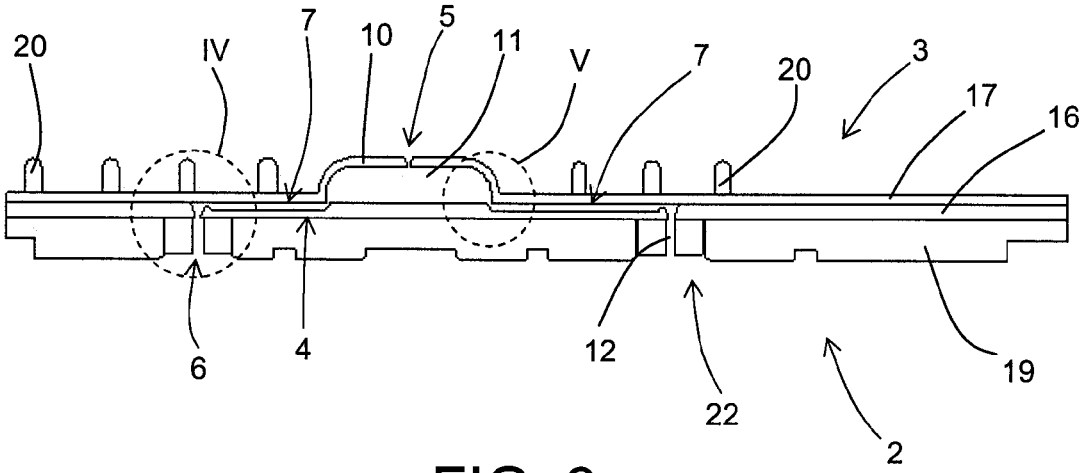
FIG. 3 is a schematic cross-section according to the line III-III of the detail illustrated in FIG. 2.

As shown in FIG. 3, in the preferred embodiment, at least at the ventilation duct 4, the sole structure 1 consists of at least a first, lower body 16 and a second, upper body 17 positioned on top of the first body 16 and integral with it. In particular, the first and second bodies 16, 17 are advantageously made of plastic material and may be rendered integral with one another by welding or gluing.

The first and second bodies 16, 17, are shaped in such a way that at least the main stretch 7 and the chamber 11 are delimited at the bottom by the first body 16 and at the top by the second body 17. In particular, the first body 16 forms the dome of the dome-shaped portion 10, whilst the second body 17 forms its lower base zone 18.

The outlet section 6 and the relative secondary stretch 12 of the ventilation duct 4 are made completely in the first body 16.

However, for production reasons, in the preferred embodiment at least at the ventilation duct 4 and the dome-shaped portion 10, the sole structure 1 also comprises at least a third body 19 fixed under the first body 16 and in practice designed to form at least part of the tread of the item of footwear. The third body 19 is also fixed to the second body 17.

Figure 6:
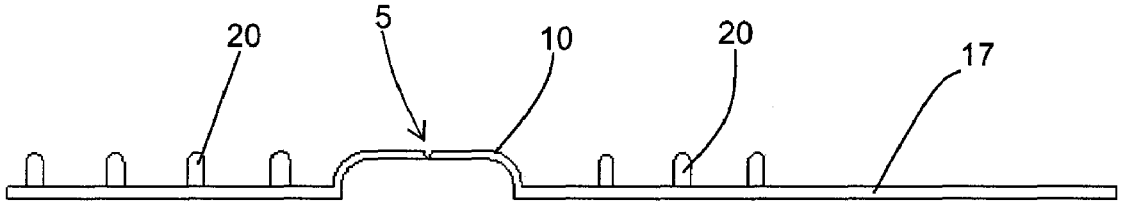
FIGS. 6 to 8 individually show the various components of the detail of the breathable sole structure of FIG. 3.
Figure 7:
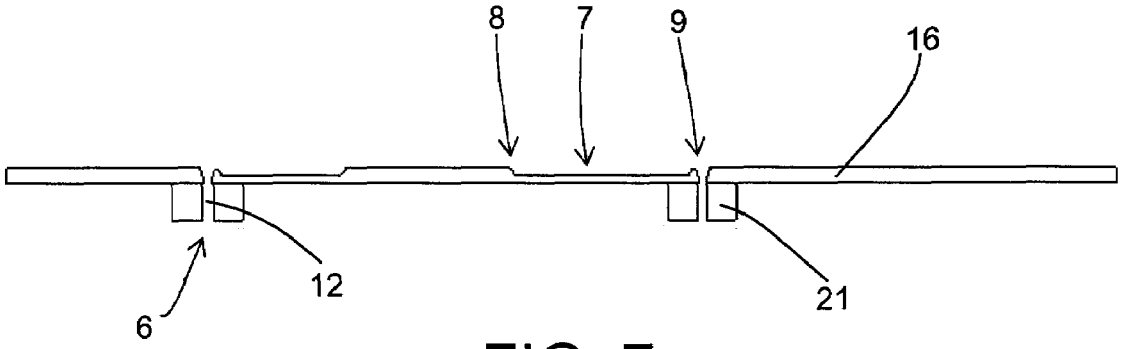
Figure 8:
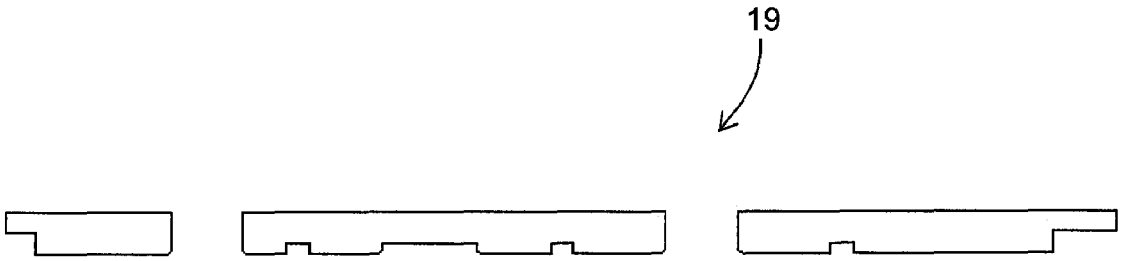

The first, second and third bodies 16, 17 and 19 are respectively schematically illustrated in an exploded style in FIGS. 6 to 8. It should be noticed that to provide a better view of the features of each of the bodies 16, 17, 19, FIGS. 3 to 8 schematically illustrate what is found precisely at the cross-section plane, in many cases not showing what is found in the background.

FIG. 6, like FIGS. 3 and 10, also shows that the upper face 3 may have a plurality of supporting projections 20 also made of elastically deformable material and having a height, relative to the upper face 3, substantially matching that of any dome-shaped portions 10 located near them.

In addition, at each outlet section 6, the first body 16 has at least one protuberance 21 extending downwards, inserted through the third body 19. Said protuberance 21 gives directly onto the lower face 2, but is preferably positioned in such a way that it is slightly recessed compared with the remaining tread (FIG. 4). In general, the lower face 2, at least at the outlet sections, preferably has a recessed surface 22 so as to facilitate air change between the ventilation duct 4 and the outside. For the same reason the lower face 2 may also have grooves 23 extending from the recessed surface 22 at the outlet section 6 towards the edges of the sole 1 or, at least, towards the edges of an insert 24 in which the ventilation ducts 4 are made (as illustrated in the accompanying drawings).

FIG. 10 is a top view of an alternative embodiment of the second body 17, showing the lower portions 18, 25 of the main stretch 7 and the dome-shaped portion 10, as well as the zones 26 joining the second body 17 to the first body 16.

In this embodiment, as in the one described above, the main stretch 7 is directly connected both to the chamber 11 and to the secondary stretch 12. However, there are some differences. Firstly, at the first end 8, the main stretch 7 extends in the form of a groove 27 on the base of the chamber 11. Secondly, at the second end 9, the main stretch 7 has an extended zone 28 which, in practice, is obtained with a ring-shaped joining zone 26 which surrounds, at a predetermined distance, the second end 9 of the main stretch 7.

However, it should be noticed that, depending on requirements, the features described above relative to the different embodiments may be combined in the way considered most suitable.

In the preferred embodiment of the present invention, the breathable sole structure 1 comprises at least one main body 29 and one or more inserts 24 which are inserted in through-holes 30 made in the main body 29. In the embodiment in FIG. 1, for example, the sole structure 1 comprises a main body 29 having the shape of a conventional sole, in the front portion of which a through-hole 30 is made in the shape of a pipe/pistol and in which an insert 24 shaped to match the hole is inserted.

The insert 24 is then fixed to the main body 29 so as to guarantee a seal to prevent infiltration by water. This may be achieved, for example, by moulding the main body 29 directly on the insert 24.

In accordance with the present invention, the ventilation ducts 4 (like the relative dome-shaped portions 10) are completely made in the insert 24. Also in accordance with the present invention, at least the portion of the sole structure 1 where the ventilation ducts 4 are present (advantageously the entire insert 24 when it is present) is made of a plastic material, such as TPU, PVC or TR, which is in itself waterproof.

Operation of the sole structure 1 disclosed is immediately relative to the structural description above.

In particular, when the user puts his foot on the ground it compresses the dome-shaped portion 10, substantially keeping the inlet section 5 of the ventilation duct 4 closed. The air contained in the chamber 11 is therefore pumped towards the outside through the main stretches 7 of the ventilation ducts 4. Suitably sizing the chamber 11 may ensure that after its compression the volume of air moved is such that it completely changes the air contained in the main stretches 7. Positioning the outlet section 6 at raised zones of the tread facilitates air expulsion.

When the foot is lifted again, the inlet section 5 is freed, so that the dome-shaped portion 10 subsequently returning to its non-deformed condition causes air to be sucked into the item of footwear, in the chamber 11.

Repetition of this sequence with each step therefore results in a continuous change in the air inside the item of footwear.

If the item of footwear is used in the presence of water, the sole structure 1 disclosed substantially prevents the water from penetrating despite the fact that it does not present any evident physical barrier. With each step taken, any water which has infiltrated the secondary stretch 12 or the main stretch 7 is expelled thanks to the thrust of the air pumped through the ventilation duct 4. Moreover, thanks to the fact that the ventilation duct 4 is made of an elastically deformable material, once the user has completely put down his foot, expelling the air, the main stretch 7 is also compressed. In this way, it is practically closed so that on one hand any water residue inside it is expelled, whilst on the other hand re-entry of water from outside is prevented.

With regard to this, it should be noticed that the Applicant has carried out several tests on the dynamic watertightness of a sole structure 1 made in accordance with the present invention. In particular, tests were performed on a sole structure 1 of the type illustrated in FIG. 1 made entirely of polymeric plastic material and having six ventilation ducts 4 converging in two dome-shaped portions 10.

Each duct was without inner barriers designed to themselves prevent the passage of water (such as breathable but waterproof membranes) and had a cross-section of less than 4 $mm^2$ in the secondary stretch 12 and less than 2 $mm^2$ in the main stretch 7).

The tests carried out simulated a walk in water 11 mm deep, and revealed how after 4000 steps the increase in the weight of the entire item of footwear (from 450 to 453 g) corresponded perfectly to the increase in weight due to the penetration of water only in the outer gaps of the sole. The inside of the item of footwear remained perfectly dry.

The present invention brings important advantages. Thanks to the present invention, it was possible to provide a sole structure which as well as allowing excellent breathability guarantees, in normal conditions of use, optimum resistance to water.

Moreover, thanks to the fact that the holes are without waterproof barriers, the sole structure disclosed guarantees greater air change than prior art soles in which the presence of waterproof barriers creates significant resistance to the movement of air.

It should also be noticed that the present invention is relatively easy to produce and even the cost linked to implementation of the invention is not very high.

The invention described may be modified and adapted in several ways without thereby departing from the scope of the inventive concept.

All details of the invention may be substituted by other technically equivalent elements and, in practice, all of the materials used, as well as the shapes and dimensions of the various components, may be any according to requirements.

What is claimed is:

1. A breathable sole structure having a lower face (2) which in practice forms the tread of an item of footwear to which the sole is applied, and an upper face (3) which is practice can face the inside of the item of footwear to which the sole is applied, the breathable sole structure (1) having at least one ventilation duct (4) extending from an inlet section (5) made in the upper face (3) to an outlet section (6) made in the lower face (2), the sole structure being characterised in that the duct comprises at least one main stretch (7) extending in a plane substantially parallel with a longitudinal direction of extension of the breathable sole structure (1) and having a first end (8) and a second end (9) in fluid communication with the duct outlet section (6), and also being characterised in that it also comprises at least one dome-shaped portion (10), made of an elastically deformable material and extending in a raised fashion from the upper face (3), said dome-shaped portion (10) forming inside it a chamber (11) in fluid communication with the first end (8) of the main stretch (7) of the duct and having an opening which puts in communication the chamber (11) and the outside of the upper face (3) and which forms the ventilation duct (4) inlet section (5).

2. The breathable sole structure according to claim 1, characterised in that the main stretch (7) of the ventilation duct (4) extends in the thickness of the breathable sole structure (1).

3. The breathable sole structure according to claim 1, characterised in that it comprises a plurality of ventilation ducts (4) each having a main stretch (7) whose first end (8) is connected to the dome-shaped portion (10) which constitutes a shared stretch for the ventilation ducts (4).

4. The breathable sole structure according to claim 3, characterized in that the chamber (11) of the dome-shaped portion (10) has a volume greater than the sum of the volumes of all of the main stretches (7) of the ventilation ducts (4) connected to it.

5. The breathable sole structure according to claim 1, characterised in that it comprises a plurality of ventilation ducts (4) and a plurality of dome-shaped portions (10), each dome-shaped portion (10) forming a chamber (11) in fluid communication with the first end (8) of at least one main stretch (7) of a ventilation duct (4).

6. The breathable sole structure according to claim 1, characterised in that the main stretch (7) of each ventilation duct (4) is obtained in a portion of the breathable sole structure (1) made of elastically deformable material.

7. The breathable sole structure according to claim 1, characterised in that the chamber (11) of the dome-shaped portion (10) has a volume greater than that of the main stretch (7) of the ventilation duct (4) connected to it.

8. The breathable sole structure according to claim 1, characterised in that the ventilation duct (4) has at least one narrowing (15) at least near to one of the first and second ends (8), (9) of the main stretch (7).

9. The breathable sole structure according to claim 1, characterised in that the main stretch (7) is directly connected to the chamber (11) and in that at its first end (8) there is a groove (27) aligned with it and extending on the base of the chamber (11).

10. The breathable sole structure according to claim 1, characterised in that, at its second end (9), the main stretch (7) has an extended zone (28).

11. The breathable sole structure according to claim 1, characterised in that the ventilation duct (4) has at least one secondary stretch (12) forming the outlet section (6) and connected to the second end (9) of the main stretch (7).

12. The breathable sole structure according to claim 11, characterised in that the secondary stretch (12) extends perpendicularly to the main stretch (7).

13. The breathable sole structure according to claim 11, characterised in that the secondary stretch (12) has a cross-section of less than 4 $mm^2$.

14. The breathable sole structure according to claim 1, characterised in that, at least at the ventilation duct (4), it consists of at least a first, lower body (16) and a second, upper body (17) positioned on top of the first body (16), said bodies being made of a plastic material and integral with one another.

15. The breathable sole structure according to claim 14, characterised in that the main stretch (7) and the chamber (11) are delimited at the bottom by the first body (16) and at the top by the second body (17).

16. The breathable sole structure according to claim 14, characterised in that the outlet section (6) is made in the first body (16).

17. The breathable sole structure according to claim 14, characterised in that it also comprises at least at the ventilation duct (4) and the dome-shaped portion (10), at least a third body (19) fixed under the first body (16) and in practice designed to form at least part of the tread of the item of footwear.

18. The breathable sole structure according to claim 17, characterized in that the outlet section (6) is made in the first body (16) and in that at each outlet section (6) the first body (16) has at least one protuberance (21) extending downwards, being inserted through the third body (19) and forming a recessed portion of the tread.

19. The breathable sole structure according to claim 1, characterised in that at least at the outlet section (6) the lower face (2) has a recessed surface (22).

20. The breathable sole structure according to claim 19, characterised in that the lower face (2) also has grooves (23) extending from the recessed surface (22).

21. The breathable sole structure according to claim 1, characterised in that the main stretch (7) of the ventilation duct (4) has a cross-section of less than 2 $mm^2$.

22. The breathable sole structure according to claim 21, characterised in that the main stretch (7) of the ventilation duct (4) has a cross-section less than or equal to 1 $mm^2$.

23. The breathable sole structure according to claim 22, characterised in that it comprises at least one main body (29) and one or more inserts (24) inserted through the main body (29), each insert (24) forming at least one ventilation duct (4).

24. The breathable sole structure according to claim 23, characterised in that the inserts (24) are made of a plastic material, such as TPU, PVC or TR.

25. The breathable sole structure according to claim 24, characterised in that at least one insert (24) is positioned at a zone of the sole structure (1) corresponding to the zone where the sole of the foot rests.

26. The breathable sole structure according to claim 1, characterised in that at least at the ventilation ducts (4) it is made of a waterproof plastic material, such as TPU, PVC or TR.

27. A breathable item of footwear, characterised in that it comprises a sole structure (1) made in accordance with claim 1.

28. The breathable item of footwear according to claim 27, characterised in that it also comprises a breathable insole and/or arch-support positioned above the upper face (3) of the sole structure (1).

* * * * *